US005779491A

United States Patent [19]

Nagano et al.

[11] Patent Number: 5,779,491

[45] Date of Patent: Jul. 14, 1998

[54] MULTIPOLAR ELECTRICAL CONNECTOR

[75] Inventors: Hiroyuki Nagano, Yamatotakada; Hideo Nagata, Otsu, both of Japan

[73] Assignees: Hosiden Corporation, Osaka; Nintendo Co., Ltd., Kyoto, both of Japan

[21] Appl. No.: 600,921

[22] PCT Filed: Aug. 24, 1995

[86] PCT No.: PCT/JP95/01688

§ 371 Date: Feb. 27, 1996

§ 102(e) Date: Feb. 27, 1996

[87] PCT Pub. No.: WO96/07218

PCT Pub. Date: Mar. 7, 1996

[30] Foreign Application Priority Data

Aug. 31, 1994 [JP] Japan ..... 6-207325

[51] Int. Cl.[6] ..... H01R 13/453

[52] U.S. Cl. ..... 439/141

[58] Field of Search ..... 439/381, 567, 439/108, 607, 79, 140–1

[56] References Cited

U.S. PATENT DOCUMENTS

| | | | |
|---|---|---|---|
| 2,935,726 | 5/1960 | Raymond | 439/763 |
| 3,739,322 | 6/1973 | Haegert | 439/764 |
| 3,893,744 | 7/1975 | Porazinski | 439/763 |
| 4,808,127 | 2/1989 | Swanic | 439/139 |
| 4,969,834 | 11/1990 | Johnson | 439/504 |
| 5,167,516 | 12/1992 | Tan et al. | 439/141 |
| 5,466,164 | 11/1995 | Miyazaki et al. | 439/140 |
| 5,492,780 | 2/1996 | Okada | 439/765 |

FOREIGN PATENT DOCUMENTS

| | | |
|---|---|---|
| 61-99979 | 6/1986 | Japan . |
| 63-205075 | 8/1988 | Japan . |
| 64-7777 | 1/1989 | Japan . |
| 2-256183 | 10/1990 | Japan . |
| 4-136882 | 12/1992 | Japan . |

*Primary Examiner*—Khiem Nguyen
*Assistant Examiner*—Eugene G. Byrd
*Attorney, Agent, or Firm*—Jones, Tullar & Cooper, P.C.

[57] ABSTRACT

It is an object of the invention to provide a configuration wherein, in a multipolar electrical connector B, when a counter electrical connector 100 is not inserted, a number of contacts 3 are individually protected from an external force, and, when the counter electrical connector 100 is inserted, even if the contacts are somewhat bent, the contacts can be connected in an unforced manner with contacts of the counter electrical connector. In the multipolar electrical connector B, a cover member 4 is disposed in an insertion space 2 formed in the body 1, so as to be movable in extracting and retracting directions. The tip ends of the contacts 3 are housed in hole portions 41 of the cover member 4. Spring members 5 for urging the cover member 4, and an engaging mechanism 10 which restricts the position of the cover member are disposed between the body 1 and the cover member 4.

8 Claims, 10 Drawing Sheets

MULTIPOLAR ELECTRICAL CONNECTOR

TECHNICAL FIELD

The present invention relates to a multipolar electrical connector, and particularly to a multipolar electrical connector in which a number of contacts are arranged and protruded into an insertion space for a counter connector.

BACKGROUND ART

In a multipolar electrical connector of this kind, contacts are configured by pins of a diameter of 0.8 mm, or by thinner pins of a diameter of 0.5 mm. The distance between adjacent contacts (the pitch of the contacts) is as small as about 2 mm. If one of the contacts is bent and the pitches of the contacts are partly disturbed so that the pitches are no longer uniform, there arise problems as follows. When a counter electrical connector is inserted into an insertion space of the body, the end face of the counter electrical connector bumps against the contact, with the result that the counter electrical connector cannot be completely inserted. When the counter electrical connector is further inserted by force, the contact which bumps against the end face buckles.

Such misalignment of contact pitches due to a bend of a contact easily occurs, for example, in the case where an external force is accidentally applied to a contact in handling such as that the multipolar electrical connector is transported or mounted to an apparatus, or where one or more of the contacts are twisted when a counter electrical connector is inserted into an insertion space for the connector.

In a prior art multipolar electrical connector, an insertion space is defined and a number of contacts are pressingly inserted into the body, thereby protruding them into the insertion space for a counter electrical connector, which insertion space is disposed in the body. Therefore, a sort of protection against an external force is realized as a whole by peripheral walls which define the insertion space. However, such protection is not done in such a manner that the contacts are individually prevented from being subjected to an external force. Consequently, a bend or buckling of a contact which may occur in the case such as where an external force is accidentally applied or where one or more of the contacts are twisted by a counter electrical connector inserted into the insertion space cannot be surely prevented from occurring.

SUMMARY OF THE INVENTION

It is an object of the present invention to provide a multipolar electrical connector wherein a cover member is disposed in an insertion space of the body, the cover member being displaceable in the insertion space together with a counter electrical connector which is to be inserted into and extracted from the insertion space, and the multipolar electrical connector is configured so that, when the counter electrical connector is not inserted into the insertion space, the tip ends of the contacts do not protrude outside of the cover member, whereby, when the counter electrical connector is not inserted, the contacts are individually protected from an external force.

It is another object of the present invention to provide a multipolar electrical connector wherein the connector is configured so that, even in the case where a contact is bent, when the bend is formed under certain conditions, the contact is introduced into a hole portion of a counter electrical connector when the counter electrical connector is inserted into an insertion space of the body, while being guided by a hole portion which is formed in a cover member, whereby all contacts can be respectively connected in an unforced manner with contacts of the counter electrical connector.

In order to attain the noted objects, the multipolar electrical connector of the present invention is a multipolar electrical connector which comprises a body having an insertion space for a counter electrical connector, and a number of contacts which protrude into the insertion space while being arranged at predetermined spaces, wherein the connector further comprises: a cover member which is placed in the insertion space, covers an opening portion of the insertion space, and is displaceable in the insertion space in directions of inserting and extracting the counter electrical connector; a number of hole portions which are opened in the cover member in an arranged manner and into which contacts are loosely inserted, respectively; a spring member which is interposed between the body and the cover member and always urges the cover member in the direction of extracting the counter electrical connector; and an engaging mechanism which is interposed between the body and the cover member, restricts a position of the cover member which is urged by the spring member, thereby blocking the cover member from protruding from the insertion space, and, when the position of the cover member is restricted, places tip ends of the contacts at intermediate portions in an axial direction of the hole portions of the cover member, the hole portions respectively corresponding to the contacts.

According to the multipolar electrical connector of the present invention, when the counter electrical connector is not inserted into the insertion space of the body (noninsertion period), the cover member urged by the force of the spring member is displaced to a position to which the cover member is restricted by the engaging mechanism, and, in this state, the tip ends of the contacts are placed at intermediate portions in an axial direction of the hole portions of the cover member which respectively correspond to the contacts. Therefore, the tip ends of the contacts which are housed in the insertion space for the counter electrical connector do not protrude to the outside of the cover member, and hence the case where the contacts are hit by something never happens.

When the counter electrical connector is inserted into the insertion space of the body (insertion period), the cover member is pushed against the force of the spring member by the counter electrical connector so as to be forcedly moved in the insertion direction. As the cover member is pushed inward, the contacts relatively protrude from the respective hole portions of the cover member, and the tip ends of the contacts are introduced into the respective hole portions of the counter electrical connector while being guided by the hole portions of the cover member.

In the multipolar electrical connector, preferably, the diameter of an opening portion of each of the hole portions of the cover member has a size which is not greater than that of an opening portion of each of the contact introducing hole portions which are opened in the end face of the counter electrical connector.

According to this configuration, the case where the tip ends of the contacts protrude from the hole portions of the cover member and collide against or are caught by the end face of the counter electrical connector never happens. Therefore, the above-mentioned function that the tip ends of the contacts are introduced into the respective hole portions of the counter electrical connector while being guided by the hole portions of the cover member is more remarkably exerted.

In the multipolar electrical connector, a configuration may be employed in which a number of contacts which are pressingly inserted into the body protrude into the insertion space for the counter electrical connector, the insertion space being formed in the body.

According to this configuration, the whole of the portions of the contacts which protrude into the insertion space is covered by the body and the cover member, and hence the tip ends of the contacts do not protrude outside of the cover member so that the case where the contacts are hit by something never happens. Preferably, the spring member is interposed between the body and both ends in the longitudinal direction of the cover member in the insertion space for the counter electrical connector.

In the thus configured multipolar electrical connector, a configuration may be employed in which an engaging claw which protrudes outwardly more than an edge of the cover member is disposed respectively on both sides of the center of the cover member, openings are formed in peripheral walls defining the insertion space for the counter electrical connector, the openings respectively housing the engaging claws in such a manner that the engaging claws are displaceable in the directions of inserting and extracting the counter electrical connector, the engaging mechanism is configured by opening edges of the openings which opening edges are positioned in the direction of extracting the counter electrical connector, and faces of the engaging claws which oppose the opening edges, respectively. In this case, preferably, faces of the engaging claws which are on the sides opposite to the faces opposing the opening edges, are inclined in such a manner that, moving more outwardly, the faces are positioned in the direction of extracting the counter electrical connector.

According to this configuration, the cover member can be attached to the body only by pushing the cover member into the insertion space of the body while using the inclined faces of the engaging claws disposed on the cover member as a guide.

In the thus configured multipolar electrical connector, preferably, the peripheral walls defining the insertion space for the counter electrical connector serve as a positional alignment guide for the insertion of the counter electrical connector into the insertion space.

In this configuration, the hole portions of the counter electrical connector are positionally aligned with the hole portions of the cover member by the peripheral walls defining the insertion space for the counter electrical connector. Therefore, the above-mentioned function that the tip ends of the contacts are introduced into the respective hole portions of the counter electrical connector while being guided by the hole portions of the cover member is more remarkably exerted.

DESCRIPTION OF THE PREFERRED EMBODIMENTS

Figure 1:
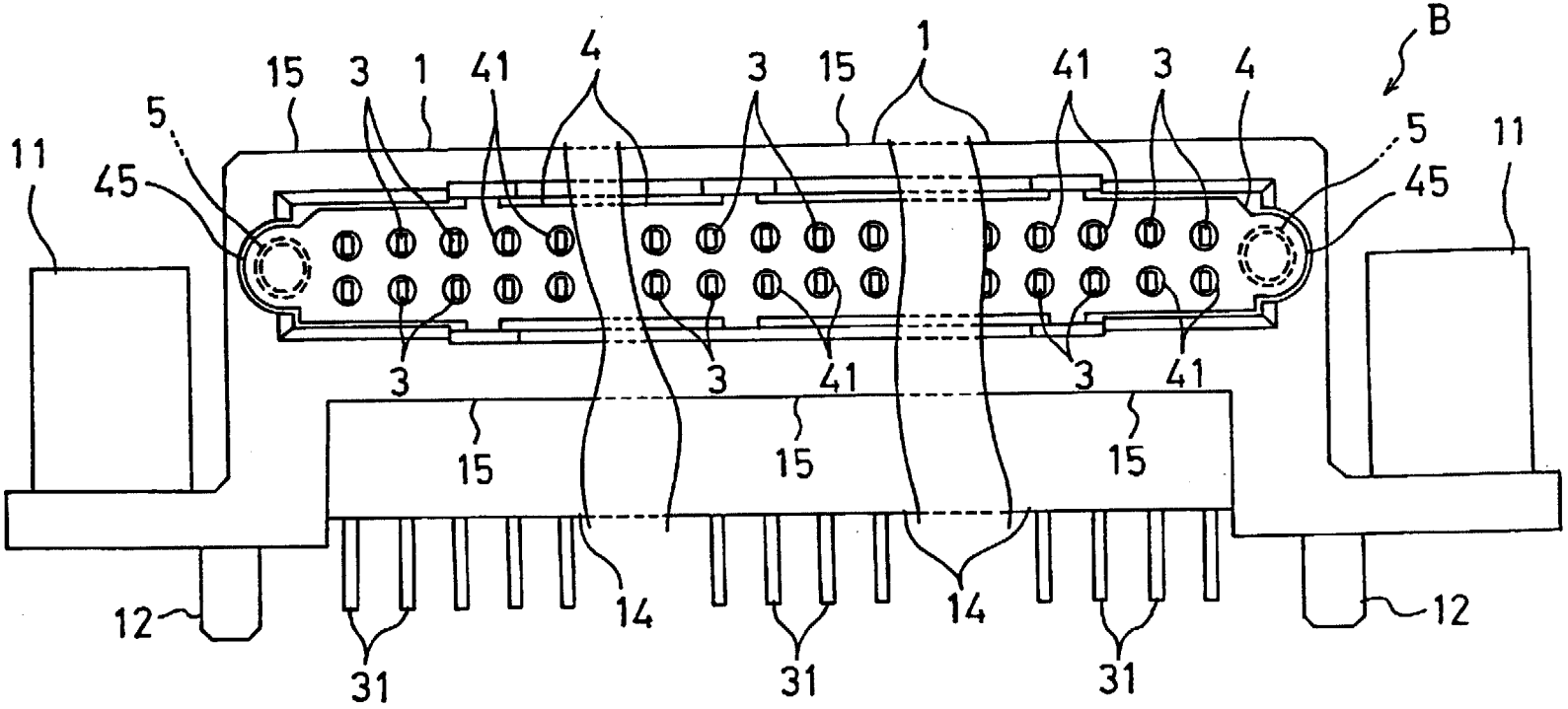
FIG. 1 is a partly cutaway plan view showing a multipolar electrical connector of an embodiment of the present invention.

In a multipolar electrical connector B shown in FIGS. 1 to 5, the body 1 is formed from a synthetic resin which has excellent electrical insulating properties. The body 1 comprises a laterally elongating insertion space 2 into which a counter electrical connector 100 is to be inserted into and extracted from. The body 1 comprises boss portions 11 for attaching the body 1 to an apparatus or a wiring board (not shown), and positioning projections 12.

In the insertion space 2, a number of pin contacts 3 protrude, being arranged at equal spaces. In the embodiment, the contacts 3 are arranged in two rows of 30 contacts each. Each of the contacts 3 has a diameter of 0.5 to 0.8 mm, and the distance between adjacent contacts 3, 3 in the same row (the pitch of the contacts) is 2 mm. As seen from FIG. 3, the contacts 3 are pressingly inserted into through hole portions 13, which are formed in the body 1 and have a smaller diameter, so as to protrude into the insertion space 2. Pin terminal portions 31 which are respectively elongated from the contacts 3 are immovably held by a slit-like terminal holder 14 which is disposed on the side of the body 1.

Figure 4:
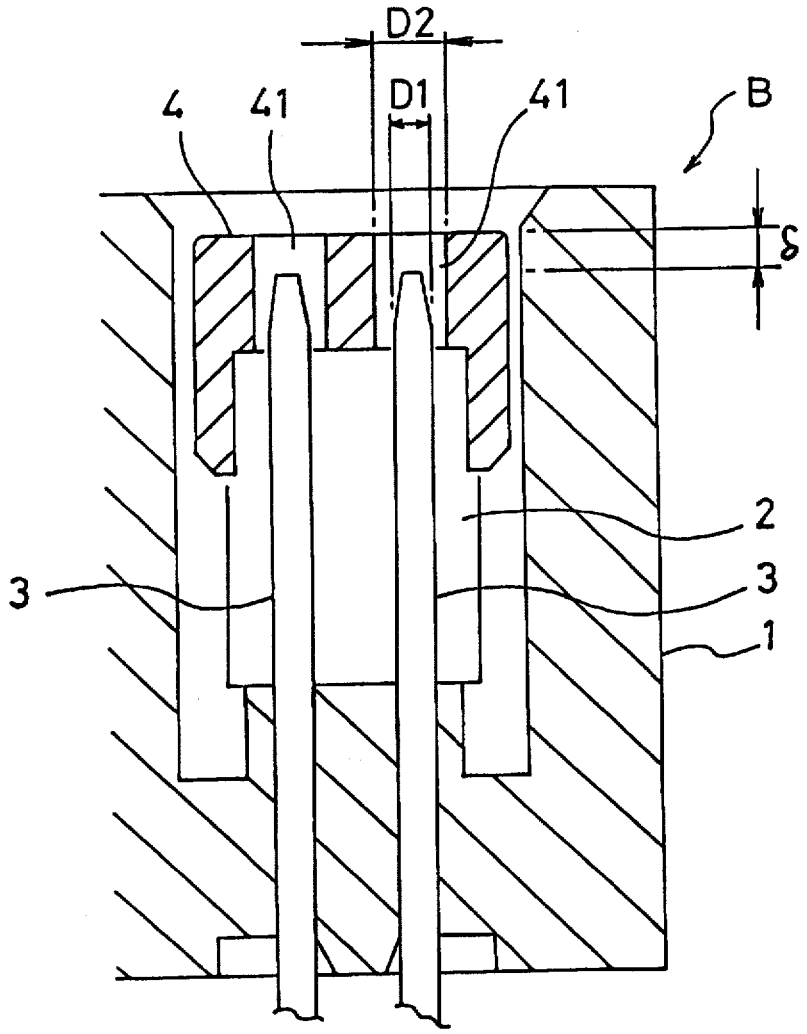
FIG. 4 is an enlarged view showing the main portion of FIG. 3.

The reference numeral 4 designates a cover member. The cover member has a shape in plan view which is similar to that of the insertion space 2, and a size which, when the cover member 4 is fitted into the insertion space 2, the cover member can substantially cover the whole of the opening portion of the insertion space 2. In the cover member 4, a number of hole portions 41 are opened in the same arrangement pattern as that of the contacts 3. The diameter of each of the hole portions 41 is greater than that of the contacts 3. Specifically, when the contacts 3 have a diameter of 0.4 mm, the diameter of the hole portions 41 may be set to be, for example, 0.8 mm. In FIG. 4, the diameter of the contacts 3 is indicated by the reference numeral D1, and that of the hole portions 41 by the reference numeral D2.

Figure 5:
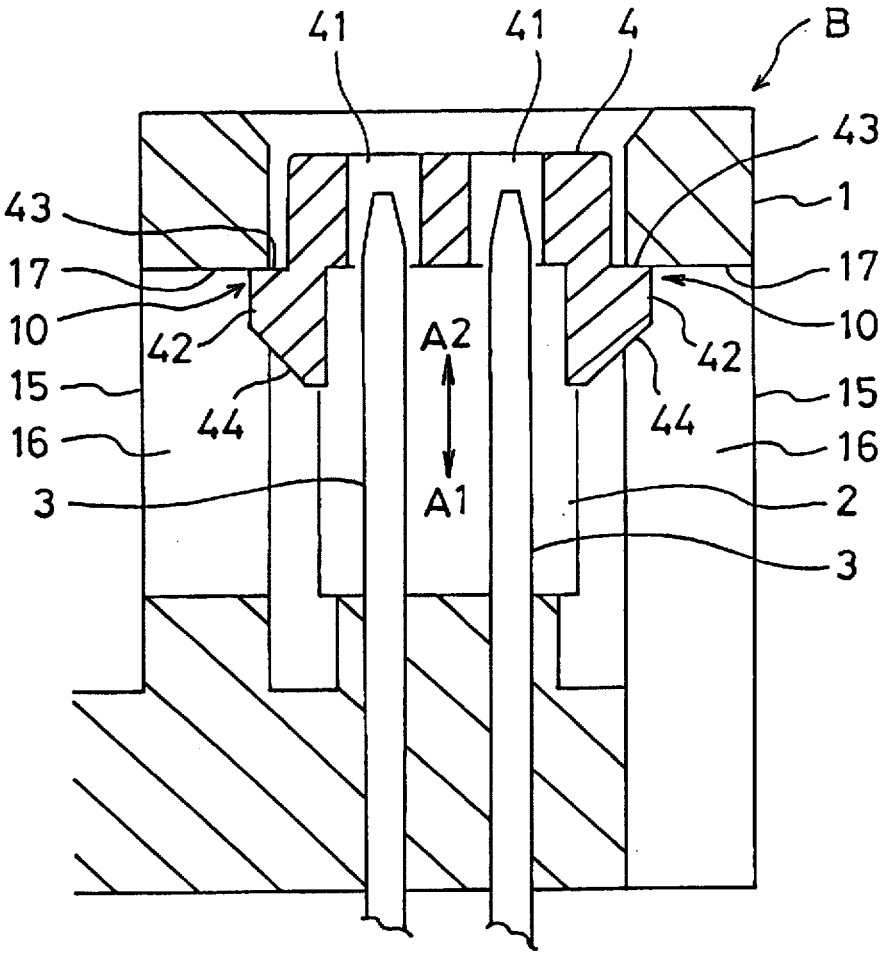
FIG. 5 is a vertical section view showing other portions of the multipolar electrical connector of FIG. 1.

As shown in FIG. 5, engaging claws 42 which protrude outwardly more than the cover member 4 are disposed on the sides which are respectively on both sides of the center of the cover member 4, specifically, on the edges in the width direction of the cover member 4. In each of the engaging claws 42, a face in a direction A2 for extracting the counter electrical connector 100, serves as an engaging face 43, and the face 44 opposite to the engaging face 43 serves as a guide face which is inclined in such a manner that, when moving outward, the face is positioned in the extraction direction A2. In contrast, longitudinally elongated openings 16 are opened in the peripheral walls 15 defining the insertion space 2 in the body 1, specifically in the peripheral walls 15 which are positioned in the width direction of the insertion space 2. The cover member 4 is disposed in the insertion space 2 in such a manner that the cover member is movable in directions A of inserting and extracting the counter electrical connector 100 and can substantially cover the whole of the opening portion of the insertion space 2.

For example, the assembling work for disposing the cover member 4 in the insertion space 2 is conducted in the following manner. Namely, the inclined guide faces 44 of the engaging claws 42 of the cover member 4 are pressed against the edges of the peripheral walls 15, and then the cover member 4 is pushed in a direction A1 so as to be pressingly inserted into the insertion space 2. This causes the engaging claws 42 to override the peripheral walls 15 to be respectively fitted into the openings 16. Then the contacts 3 are loosely fitted into the hole portions 41 which respectively correspond to them. In this way, the cover member 4 can be disposed in the insertion space 2. In the embodiment, three engaging claws 42 are formed on each of the edges in the width direction of the cover member 4, and three openings 16 are formed in each of the peripheral walls 15 which are respectively positioned on both sides in the width direction of the insertion space 2. They respectively correspond to each other so that the engaging claws 42 are fitted into the openings 16 as described above.

Figure 2:
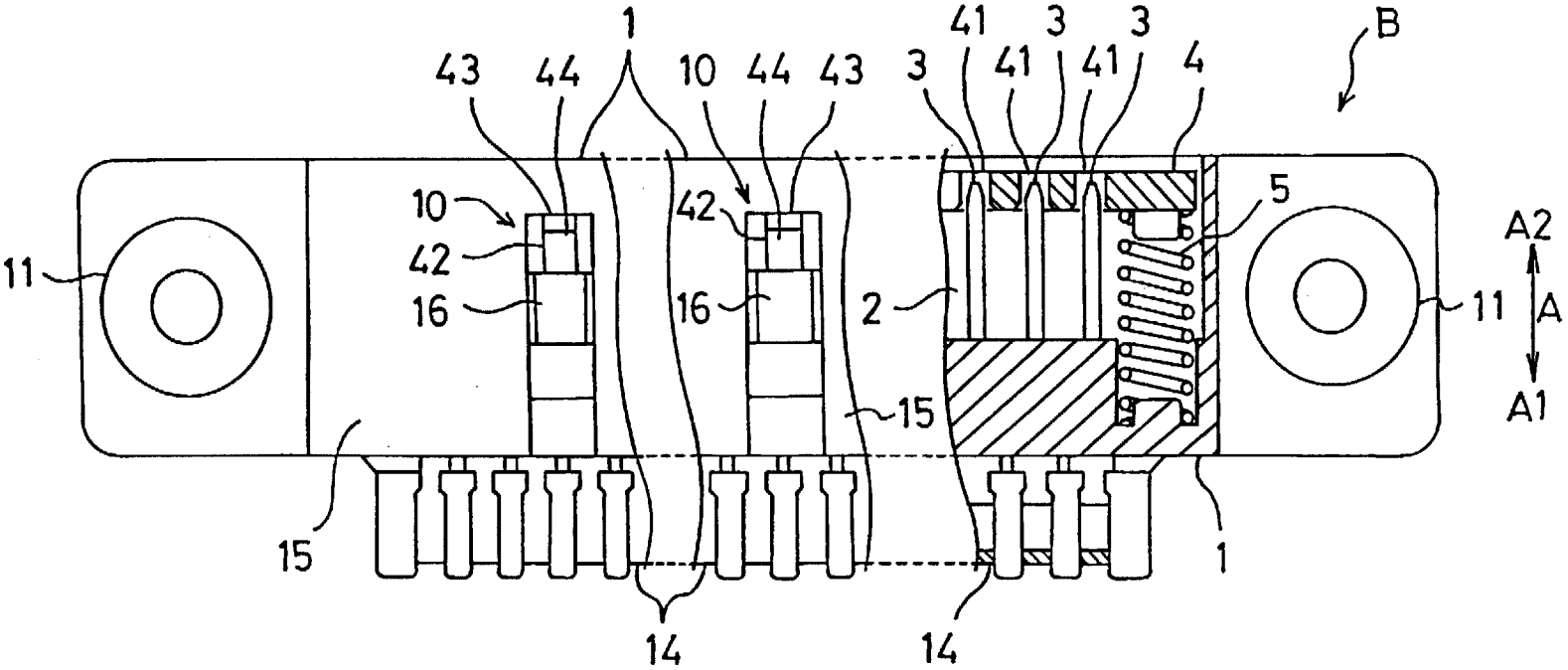
FIG. 2 is a partly cutaway and partly sectional front view showing the multipolar electrical connector of FIG. 1.
Figure 3:
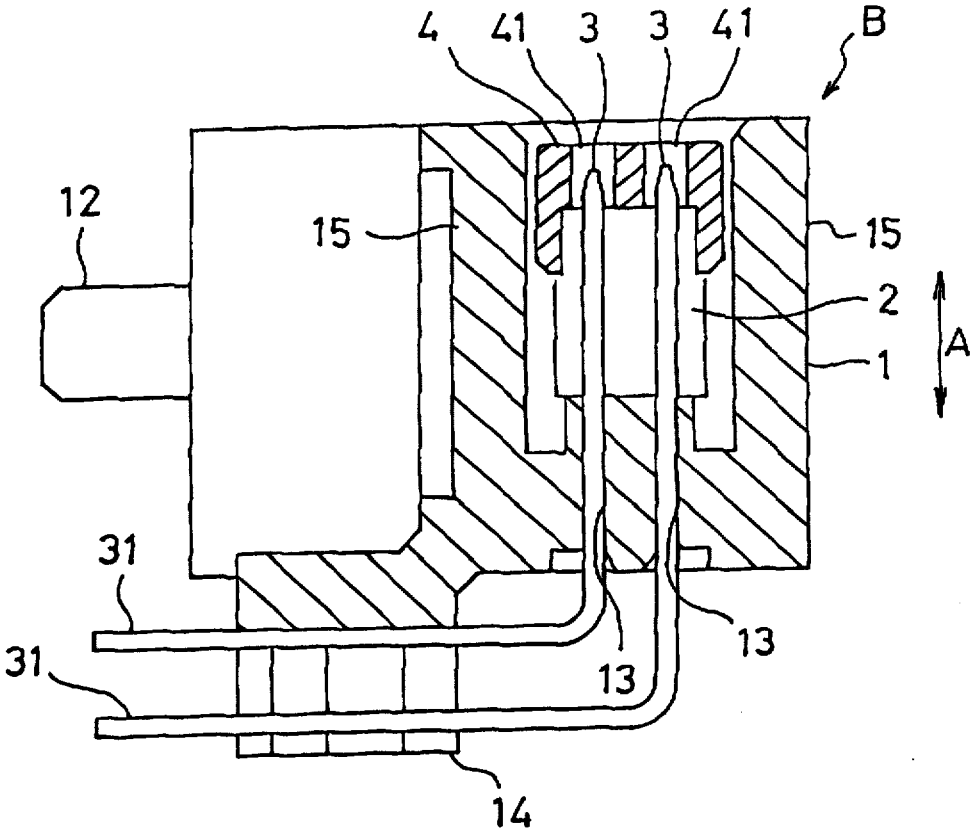
FIG. 3 is a vertical section view of the multipolar electrical connector of FIG. 1.

As seen from FIGS. 1 and 2, a spring member housing space is provided in the insertion space 2 at each end in the longitudinal direction of the peripheral walls 15, and spring members 5 each consisting of a coil spring are disposed in the spring member housing spaces. Both ends in the longitudinal direction of the cover member 4 are always urged by the spring members 5 in the direction A2. When the counter electrical connector 100 is not inserted into the insertion space 2, the engaging faces 43 of the engaging claws 42 of the cover member 4 which is urged by the spring members 5 are engaged as shown in FIG. 5 with opening edges 17 of the openings 16 which are positioned in the direction A2. When the engaging faces 43 are engaged with the opening edges 17 so that the position of the cover member 4 is restricted, the tip ends of the contacts 3 are placed at intermediate portions in the axial direction of the hole portions 41 which respectively correspond to the contacts. In FIG. 4, the distance between the tip ends of the contacts placed at the intermediate portions in the axial direction of the hole portions 41 and the opening ends of the hole portions 41 is indicated by the reference symbol δ. The distance δ is shorter than 1 mm. The opening edges 17 of the openings 16, and the engaging faces 43 of the engaging claws 42 constitute an engaging mechanism 10 which blocks the cover member 4 urged by the spring members 5 from protruding from the insertion space.

Figure 6:
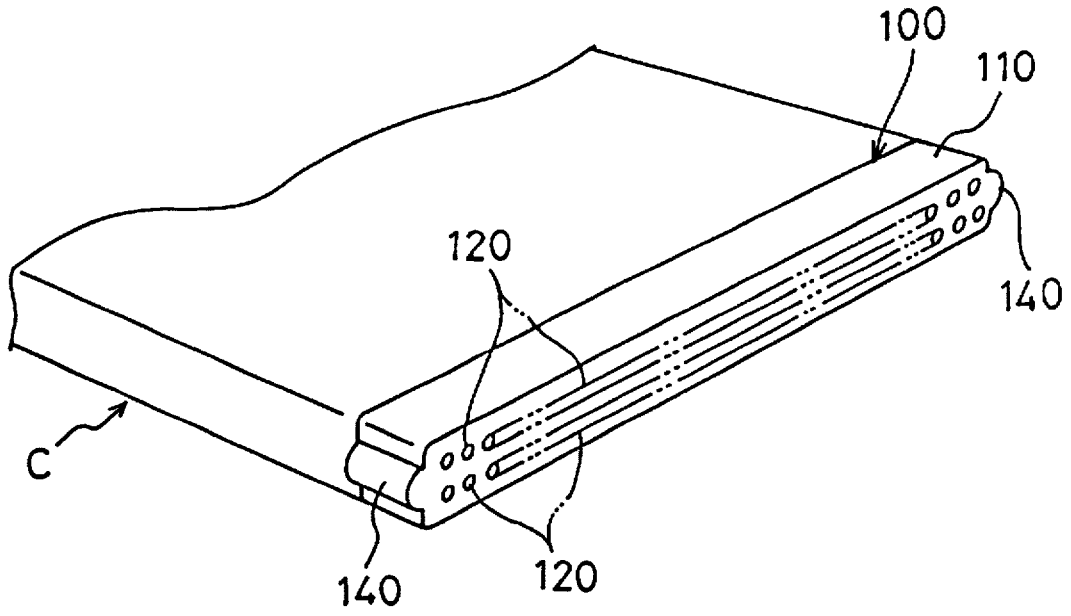
FIG. 6 is a partial perspective view of a card having a counter electrical connector.

FIG. 6 shows a card C having the counter electrical connector 100. The counter electrical connector 100 comprises a number of contact introducing hole portions 120 which are opened in the end face of the body 110 of the counter electrical connector 100. In each of the contact introducing hole portions 120, a cylindrical contact is disposed. The arrangement pattern of the contact introducing hole portions 120 is the same as that of the contacts 3 of the above-mentioned multipolar electrical connector B.

The peripheral walls 15 defining the insertion space 2 of the above-mentioned multipolar electrical connector B serve as a guide for positioning the counter electrical connector 100 when it is inserted into the insertion space 2. When the counter electrical connector 100 is to be inserted into the insertion space 2, the counter electrical connector 100 is positioned by the peripheral walls 15, whereby the contact introducing hole portions 120 of the counter electrical connector 100 are aligned with the hole portions 41 of the cover member 4, respectively. The diameter D2 of the opening portion of each hole portion 41 of the cover member 4 is set to be a size which is not greater than or is equal to or smaller than the diameter of the opening portion of each contact introducing hole portion 120 at the end face of the counter electrical connector 100.

Next, the function will be described.

When the counter electrical connector 100 is not inserted into the insertion space 2, the engaging faces 43 of the engaging claws 42 disposed on the cover member 4 which is urged by the spring members 5 are engaged as shown in FIG. 5 with the opening edges 17 of the openings 16 which are opened in the peripheral walls 15 on the side of the body 1, or, in other words, the position of the cover member 4 is restricted by the engaging mechanism 10, whereby the tip ends of the contacts 3 are placed at intermediate portions in the axial direction of the hole portions 41 of the cover member 4, respectively. Consequently, the tip ends of the contacts 3 do not protrude to the outside of the cover member 4. When the multipolar electrical connector is handled, therefore, the contacts 3 never hit anything. Accordingly, the case where the contacts 3 are subjected to an external force and are bent does not occur, and the contacts 3 are individually protected from an external force by the cover member 4. This function is exerted more remarkably by the configuration in which the contacts 3 are pressingly inserted into the body 1 and protrude into the insertion space 2.

Figure 7:
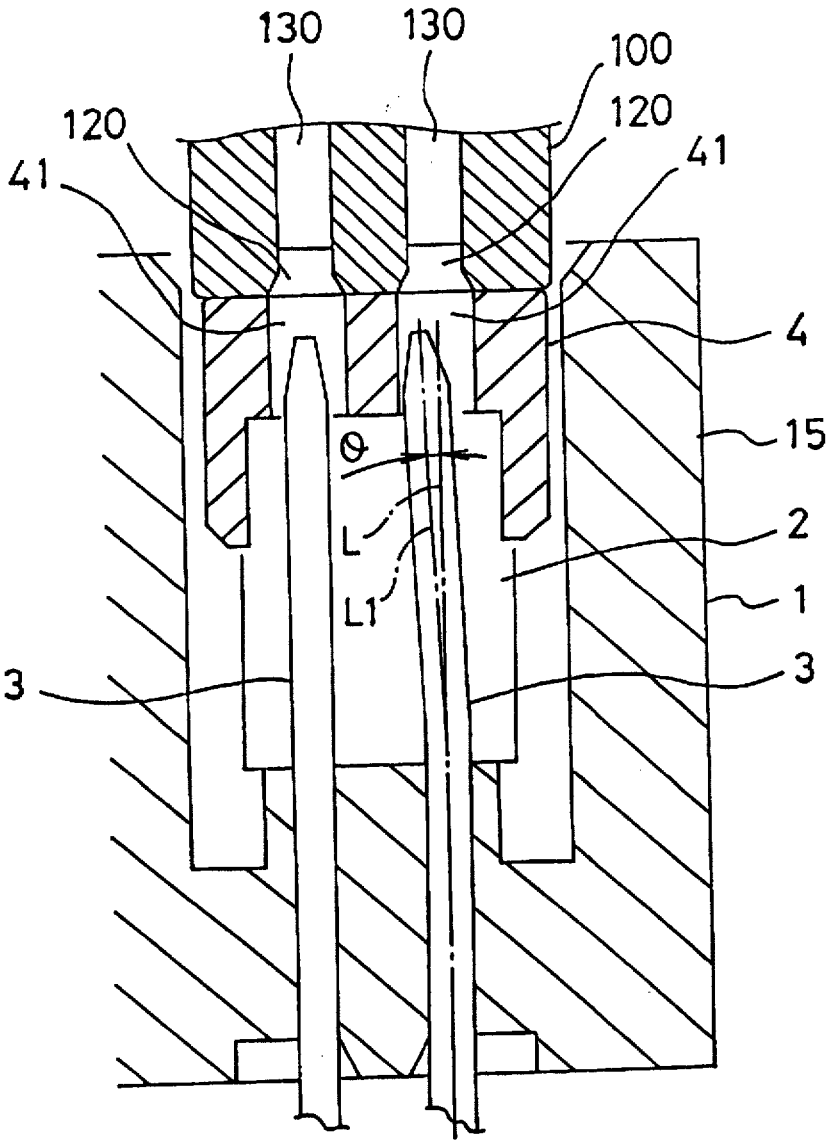
FIG. 7 is an enlarged vertical section view showing the main portion and illustrating a function of the multipolar electrical connector which is exerted when the counter electrical connector is to be inserted.
Figure 8:
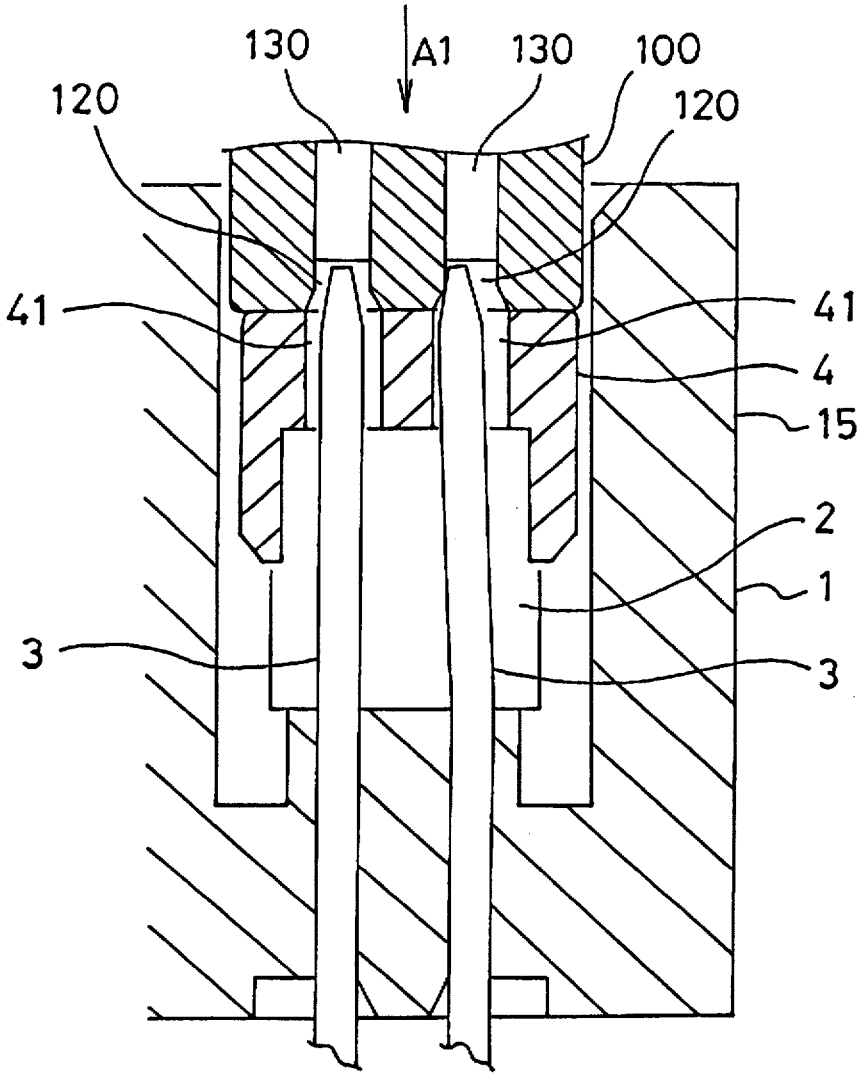
FIG. 8 is an enlarged vertical section view showing the main portion and illustrating a function of the multipolar electrical connector which is exerted when the counter electrical connector is to be inserted.

When the counter electrical connector 100 is inserted into the insertion space 2, the contact introducing hole portions 120 of the counter electrical connector 100 are individually aligned with the hole portions 41 of the cover member 4 by the guiding function of the peripheral walls 15. Furthermore, the diameter D2 of the opening portions of the hole portions 41 of the cover member 4 is not greater than the diameter of the opening portions of the contact introducing hole portions 120 which are opened in the end face of the counter electrical connector 100, and hence the case where the hole edges of the contact introducing hole portions 120 protrude into the opening portions of the hole portions 41 of the cover member 4 does not happen. When the counter electrical connector 100 is inserted into the insertion space 2, therefore, the end face of the counter electrical connector 100 bumps against the cover member 4 as shown in FIG. 7 so that the cover member 4 is pushed against the force of the spring members 5 by the counter electrical connector 100 to be pressingly inserted in the insertion direction A1. At this time, the engaging claws 42 are moved in the openings 16 in the insertion direction A1 of the counter electrical connector 100. As the claws are moved, the contacts 3 are relatively protruded from the hole portions 41 of the cover member 4, and as shown in FIG. 8 the tip ends of the contacts 3 are introduced into the contact introducing hole portions 120 on the side of the counter electrical connector 100 while being guided by the hole portions 41 of the cover member 4. As a result, the tip ends of the contacts 3 never collide against or are caught by the end face of the counter electrical connector 100.

The above-mentioned function, i.e., the function whereby the tip ends of the contacts 3 are introduced into the contact introducing hole portions 120 on the side of the counter electrical connector 100 while being guided by the hole portions 41 of the cover member 4 is exerted. Even when the axis L1 of one of the contacts 3, such as the contact 3 shown in the right side of FIG. 7 is inclined by θ with respect to the normal axis L or, in other words, the contact 3 is bent, the contact 3 can be introduced in an unforced manner into the corresponding contact introducing hole portion 120 on the side of the counter electrical connector 100. The contacts 3 which are introduced into the contact introducing hole portions 120 on the side of the counter electrical connector 100 are fitted into the cylindrical contacts 130 disposed in the contact introducing hole portions 120 so as to produce an electrical contact therewith.

In the embodiment described above, as seen from FIG. 1, a semicircular extension 45 protrudes from each end in the longitudinal direction of the cover member 4. The extensions 45 serve as spring pressers for the spring members 5. Void spaces in which the extensions 45 are displaceable are ensured in the insertion space 2. Furthermore, bulges 140 which can be fitted into the spaces provided in the insertion space 2 are formed on both ends of the counter electrical connector 100 shown in FIG. 6. When a configuration is formed in this way in which the counter electrical connector 100 is pressingly inserted into the insertion space 2 while aligning the bulges 140 disposed at both ends of the counter electrical connector 100 with the void spaces provided in the insertion space 2, the position of the counter electrical connector 100 is hardly shifted in the width direction (i.e., the vertical direction in FIG. 1) of the insertion space. Consequently, by the above-mentioned function the contacts 3 are introduced in an unforced manner into the contact introducing hole portions 120 on the side of the counter electrical connector 100.

Figure 9:
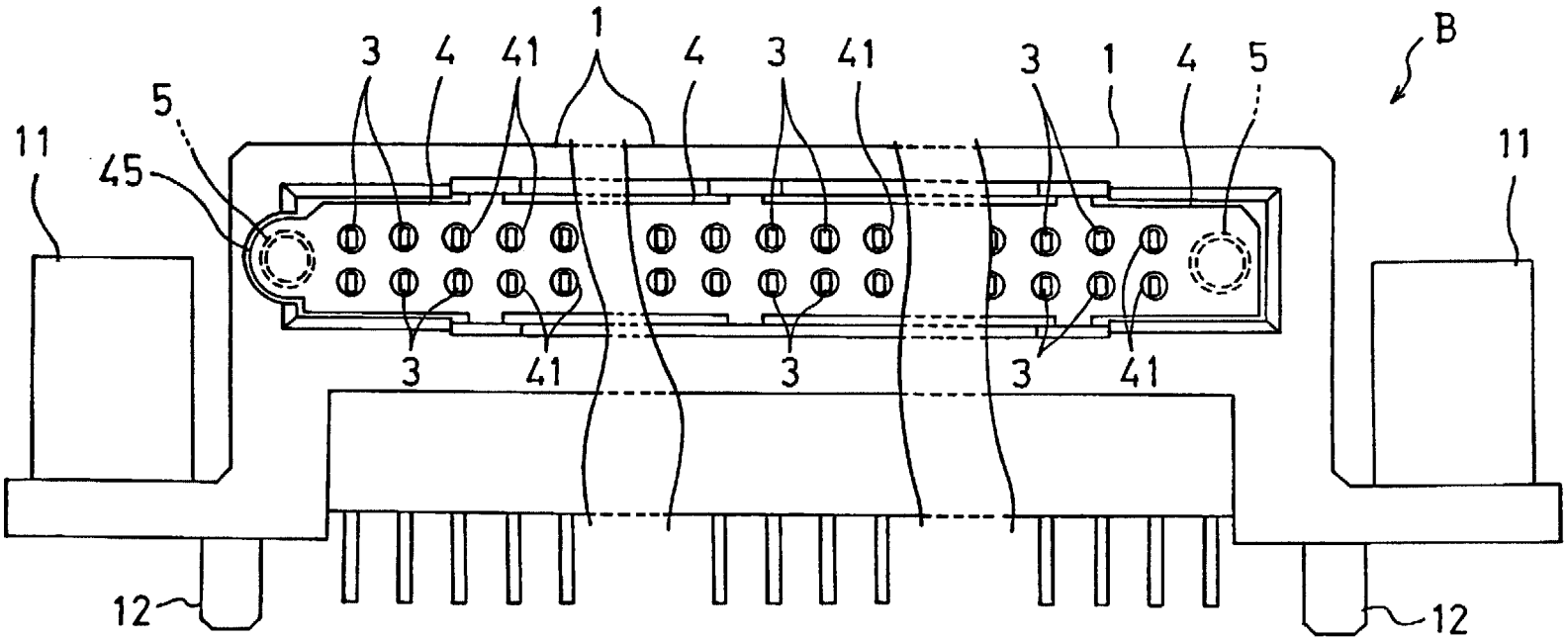
FIG. 9 is a plan view showing a multipolar electrical connector of another embodiment of the present invention, in partly cutaway.
Figure 10:
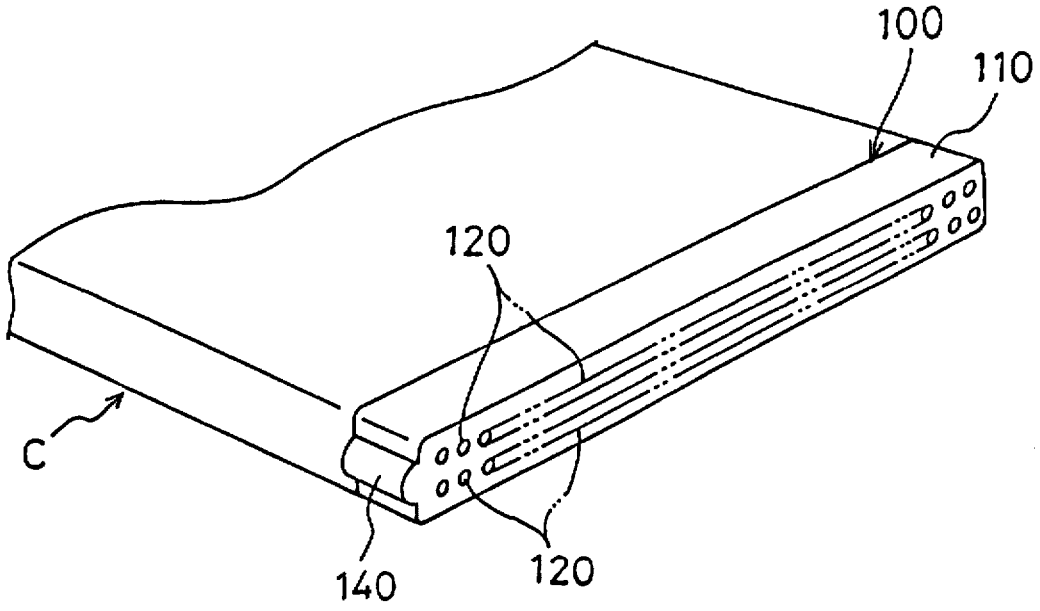
FIG. 10 is a partial perspective view of a card having a counter electrical connector.

FIG. 9 shows the multipolar electrical connector B of another embodiment. The multipolar electrical connector B is different from the connector described with reference to FIGS. 1 to 5, 7, and 8 in that the connector B is provided with the function of preventing the counter electrical connector 100 from being inserted while the rear side is directed forward, i.e., an erroneous insertion prevention function. Specifically, in the multipolar electrical connector B of the embodiment, the semicircular extension 45 protrudes only from one end in the longitudinal direction of the cover member 4, and the extension 45 serves as a spring presser for the spring member 5. In contrast, the other end in the longitudinal direction of the cover member 4 is made flat. In the insertion space 2, a void space in which the extension 45 is displaceable is provided only at the one end in the longitudinal direction of the cover member 4. In the counter electrical connector 100 for the thus configured multipolar electrical connector B, as shown in FIG. 10, a bulge 140 which can be fitted into the space provided in the insertion space 2 is formed only on one end, and the other end is made flat. According to this configuration, even when the counter electrical connector 100 is disposed to be inserted while the rear side is directed forward, the counter electrical connector 100 cannot be inserted into the insertion space 2, and hence the counter connector is prevented from being inserted while the rear side is directed forward, or an erroneous insertion is prevented from occurring. The other configuration, functions and effects are strictly identical with those described with reference to FIGS. 1 to 5, 7, and 8. Therefore, the same components are designated by the same reference numerals and their detailed description is omitted.

According to the multipolar electrical connector of the present invention, the tip ends of the contacts are disposed in the hole portions of the cover member. Consequently, the contacts are individually protected by the cover member and the case where, when the counter electrical connector is not inserted, anything hitting the contacts is provided. Therefore, the connector can attain an effect that the case where an external force is accidentally applied to a contact in handling, such as that the multipolar electrical connector is transported or mounted to an apparatus and the contact is bent, does not occur. When the counter electrical connector is not inserted, the cover member prevents dust from entering the insertion space of the body, and hence the multipolar electrical connector can attain the effect that dust does not adhere to or is not inserted between the contacts arranged at a small pitch.

When the counter electrical connector is inserted, the tip ends of the contacts are introduced into the hole portions of the counter electrical connector while being guided by the hole portions of the cover member. Even when one or more of the contacts are twisted by the counter electrical connector, therefore, the case where the tip ends of the contacts collide against or are caught by the end face of the counter electrical connector never happens. The function of guiding the tip ends of the contacts by the hole portions of the cover member is exerted as far as, when the counter electrical connector is not inserted, the tip ends of the contacts are disposed in the hole portions of the cover member. Consequently, when the counter electrical connector is not inserted, the tip ends of the contacts are disposed in the hole portion of the cover member, and even when a contact is bent, it is possible to attain the effect that the contact can be surely inserted into the hole portion of the counter electrical connector by inserting the counter electrical connector, so that all the contacts are connected in an unforced manner with the contacts of the counter electrical connector.

We claim:

1. A multipolar electrical connector, comprising:

a body having an insertion space for a counter electrical connector, said insertion space defining an opening portion;

a plurality of contacts which protrude into said insertion space, said plurality of contacts being arranged at predetermined spaces relative to each other;

a cover member which covers the opening portion of said insertion space, said cover member being displaceable in said insertion space in an insertion direction and an extraction direction relative to said counter electrical connector;

a plurality of hole portions formed in said cover member in an arranged manner and into which a respective one of said plurality of contacts are loosely inserted;

a spring member disposed between said body and said cover member for constantly urging said cover member in said extraction direction; and an engaging mechanism disposed between said body and said cover member, said engaging mechanism restricting the position of said cover member urged by said spring member thereby blocking said cover member from protruding from said insertion space, and, when the position of said cover member is restricted, permitting the tip ends of said plurality of contacts to assume intermediate positions in an axial direction of said hole portions, said hole portions respectively corresponding to said contacts, said engaging mechanism including a plurality of elongated claws which protrude outwardly from an edge of said cover member and are disposed on both sides of the center of said cover member, wherein: said engaging claws define engaging faces which oppose said opening edges, said body includes peripheral walls, openings are formed in said peripheral walls defining said insertion space, said openings respectively housing said engaging claws in such a manner that said engaging claws are displaceable in said insertion and extraction direction, and said opening edges defining a downstream end in an extraction direction of said openings for fitting said cover body inside said insertion space, each of said engaging faces for engaging a respective one of said opening edges, said opening edges and said engaging faces being positioned opposite to said plural openings of said cover member, said engaging mechanism further including a guide face for guiding said cover member including said guide face so as to be positioned in said extraction direction relative to said counter electrical connector, thereby fitting said cover body inside said insertion space, said plural claws elastically protruding outwardly from both edges of said cover member and which are housed inside said plural openings by elasticity, in fitting said cover member.

2. The multipolar electrical connector according to claim 1, wherein the counter electrical connector has a plurality of contact introducing hole portions in an end face of the counter electrical connector, and wherein the diameter of each of said hole portions has a size which is not greater than the diameter of the contact introducing hole portions.

3. The multipolar electrical connector according to claim 1, wherein said plurality of contacts are pressingly inserted into said body and protrude into said insertion space, said insertion space being formed in said body.

4. The multipolar electrical connector according to claim 1, wherein said spring member is disposed in said insertion space between said body and at at least one longitudinal end of said cover member.

5. The multipolar electrical connector according to claim 1, wherein said peripheral walls defining said insertion space serve as a positional alignment guide for insertion of the counter electrical connector into said insertion space.

6. The multipolar electrical connector according to claim 1, wherein said cover member includes a semicircular extension protruding from both ends in a longitudinal direction of said cover member, said semicircular extensions serving as spring pressers for said spring members, and wherein void spaces, in which said semicircular extensions are displaceable, are formed in said insertion space of said body.

7. The multipolar electrical connector according to claim 1, wherein said cover member includes a semicircular extension which protrudes only from one end in a longitudinal direction of said cover member, said semicircular extension serving as a spring presser for said spring member, the other end in the longitudinal direction of said cover member is made flat, and a void space in which said extension is displaceable is formed in said insertion space.

8. The multipolar electrical connector according to claim 1, wherein the tip ends of said plurality of contacts are located between the front face of said cover member and the rear face of said cover member, and the front face of said cover member is located between the front face of said body and the tip ends of said plurality of contacts, when the counter electrical connector is not inserted.

* * * * *